United States Patent [19]

Moriya et al.

[11] Patent Number: 4,929,289

[45] Date of Patent: May 29, 1990

[54] IRON-BASED SHAPE-MEMORY ALLOY EXCELLENT IN SHAPE-MEMORY PROPERTY AND CORROSION RESISTANCE

[75] Inventors: Yutaka Moriya; Tetsuya Sanpei; Hisatoshi Tagawa, all of Tokyo, Japan

[73] Assignee: NKK Corporation, Tokyo, Japan

[21] Appl. No.: 314,564

[22] Filed: Feb. 23, 1989

[30] Foreign Application Priority Data

Apr. 5, 1988 [JP] Japan ..... 63-83495

[51] Int. Cl.[5] ..... C22C 38/34; C22C 38/38

[52] U.S. Cl. ..... 148/402; 420/50; 420/34; 420/104; 420/74; 420/73; 420/112; 420/117

[58] Field of Search ..... 148/402; 420/50, 34, 420/104, 74, 73, 112, 117

[56] References Cited

U.S. PATENT DOCUMENTS 3,873,306 3/1975 Giles et al. ..... 420/70

FOREIGN PATENT DOCUMENTS 0176272 4/1986 European Pat. Off. .

1517767 3/1968 France .

2237973 2/1975 France .

59-70751 4/1984 Japan .

*Primary Examiner*—Deborah Yee

*Attorney, Agent, or Firm*—Frishauf, Holtz, Goodman & Woodward

[57] ABSTRACT

An iron-based shape-memory alloy excellent in a shape-memory property and a corrosion resistance, consisting essentially of:

chromium: from 0.1 to 5.0 wt. %,
silicon: from 2.0 to 8.0 wt. %,
manganese: from 1.0 to 14.8 wt. %,
at least one element selected from the group consisting of:
nickel: from 0.1 to 20.0 wt. %,
cobalt: from 0.1 to 30.0 wt. %,
copper: from 0.1 to 3.0 wt. %,
and
nitrogen: from 0.001 to 0.400 wt. %,
where, Ni + 0.5 Mn + 0.4 Co + 0.06 Cu + 0.002 N ≧ 0.67 (Cr + 1.2 Si),
and
the balance being iron and incidental impurities.

12 Claims, 1 Drawing Sheet

IRON-BASED SHAPE-MEMORY ALLOY EXCELLENT IN SHAPE-MEMORY PROPERTY AND CORROSION RESISTANCE

FIELD OF THE INVENTION

The present invention relates to an iron-based shape-memory alloy excellent in a shape-memory property and a corrosion resistance.

BACKGROUND OF THE INVENTION

A shape-memory alloy is an alloy which, when applied with a plastic deformation at a prescribed temperature near the martensitic transformation point and then heated to a prescribed temperature above the temperature at which the alloy reversely transforms into the mother phase thereof, shows a property of recovering the original shape that the alloy has had before application of the plastic deformation. By applying a plastic deformation to a shape-memory alloy at a prescribed temperature, the crystal structure of the alloy transforms from the mother phase thereof into martensite. When the thus plastically deformed alloy is heated thereafter to a prescribed temperature above the temperature at which the alloy reversely transforms into the mother phase thereof, martensite reversely transforms into the original mother phase, thus the alloy showing the shape-memory property. This causes the plastically deformed alloy to recover the original shape thereof that the alloy has had before application of the plastic deformation.

Non-ferrous shape-memory alloys have so far been known as alloys having such a shape-memory property. Among others, nickel-titanium and copper shape-memory alloys have already been practically used. Pipe joints, clothes, medical equipment, actuators and the like are manufactured with the use of these non-ferrous shape-memory alloys. Techniques based on application of shape-memory alloys to various uses are now being actively developed.

However, non-ferrous shape-memory alloys, which are expensive, are under economic restrictions. In view of these circumstances, iron-based shape-memory alloys available at a lower cost than non-ferrous ones are being developed. Expansion of the scope of application is thus expected for iron-based shape-memory alloys in place of non-ferrous ones under economic restrictions.

In terms of the crystal structure of martensite into which an iron-based shape-memory alloy transforms from the mother phase thereof by application of a plastic deformation, iron-based shape-memory alloys may be broadly classified into a fct (abbreviation of face-centered-tetragonal), a bct (abbreviation of body-centered-tetragonal), and a hcp (abbreviation of hexagonal-closed pack).

As iron-based shape-memory alloys which transform from the mother phase thereof into a fct martensite by applying a plastic deformation, iron-palladium and iron-platinum alloys are known. These iron-based shape-memory alloys show a satisfactory shape-memory property.

As iron-based shape-memory alloys which transform from the mother phase thereof into a bct martensite (hereinafter referred to as the "$\alpha'$-martensite") by applying a plastic deformation, iron-platinum and iron-nickel-cobalt-titanium alloys are known. The $\alpha'$-martensite is a phase which is formed in an alloy having a high stacking fault energy, resulting in a large volumic change upon transformation. A slip deformation therefore tends to occur in the $\alpha'$-martensite upon transformation, and these iron-based shape-memory alloys do not show a satisfactory shape-memory property in the as-is state. It is however known that, by making the mother phase of these iron-based shape-memory alloys have the invar effect (i.e., a phenomenon in which a thermal expansion coefficient is reduced to the minimum within a certain temperature region), a slip deformation in the $\alpha'$-martensite in these alloys is inhibited, and as a result, these alloys can show a satisfactory shape-memory property.

As iron-based shape-memory alloys which transform from the mother phase thereof into a hcp martensite (hereinafter referred to as the "$\epsilon$-martensite") by applying a plastic deformation, a high-manganese steel and a SUS 304 austenitic stainless steel spceified in JIS (abbreviation of Japanese Industrial Standards) are known. The $\epsilon$-martensite is a phase which is formed in an alloy having a low stacking fault energy, resulting in a small volumic change upon transformation. No slip deformation therefore tends to occurs in the $\epsilon$martensite upon tranformation, and these iron-based shape-memory alloys show a satisfactory shape-memory property.

As an iron-based shape-memory alloy which transforms from the mother phase thereof into the $\epsilon$-martensite by applying a plastic deformation, the following alloy has been proposed:

An iron-based shape-memory alloy, disclosed in Japanese Patent Provisional Publication No. 61-201,761 dated Sept. 6, 1986, which consists essentially of:

| | |
|---|---|
| Manganese | from 20 to 40 wt. %, |
| silicon | from 3.5 to 8 wt. %, |
| at least one element selected from the group consisting of: | |
| chromium | up to 10 wt. %, |
| nickel | up to 10 wt. %, |
| cobalt | up to 10 wt. %, |
| molybdenum | up to 2 wt. %, |
| carbon | up to 1 wt. %, |
| aluminum | up to 1 wt. %, |
| copper | up to 1 wt. %, |
| and | |
| the balance being iron and incidental impurities | |

(hereinafter referred to as the "prior art").

The above-mentioned iron-based shape-memory alloy of the prior art has an excellent shape-memory property. More particularly, the shape-memory property available in the prior art is as follows: A test piece having dimensions of 0.5 mm×1.5 mm×30 mm was prepared by melting the iron-based shape-memory alloy of the prior art in a high-frequency heating air furnace, then casting the molten alloy into an ingot, then holding the thus cast ingot at a temperature within the range of from 1,050° to 1,250° C. for an hour, and then hot-rolling the thus heated ingot. Subsequently, a plastic deformation was applied to the thus prepared test piece by bending same to an angle of 45° at a room temperature, and the test piece was heated to a prescribed temperature above the austenitic transformation point. Thus a shape recovering rate of the alloy was investigated: the alloy showed a shape recovering rate of from 75 to 90%.

The prior art discloses the addition of at least one element of chromium, nickle, cobalt and molybdenum to the alloy for the purpose of improving a corrosion resistance of the iron-based shape-memory alloy. However, the prior art has the following problems: In the prior art, at least one element of chromium, nickel, cobalt and molybdenum is added to improve a corrosion resistance of the alloy as described above. However, particularly because manganese is added in a large quantity as from 20 to 40 wt. % in the prior art, the improvement of corrosion resistance is not necessarily sufficient. Furthermore, the alloy of the prior art, which contains from 20 to 40 wt. % manganese and in addition chromium, tends to form a very brittle intermetallic compound (hereinafter referred to as the "δ-phase") because of the presence of chromium. Formation and presence of this δ-phase cause serious deterioration of the shape-memory property, the workability and the toughness of the iron based shape-memory alloy.

In view of the circumstances described above, there is a strong demand for development of an iron-based shape-memory alloy excellent in a shape-memory property and a corrosion resistance, but such an iron-based shape-memory alloy has not as yet been proposed.

SUMMARY OF THE INVENTION

An object of the present invention is therefore to provide an iron-based shape-memory alloy excellent in a shape-memory property and a corrosion resistance.

In accordance with one of the features of the present invention, there is provided an iron-based shape-memory alloy excellent in a shape-memory property and a corrosion resistance, consisting essentially of:

| | |
|---|---|
| chromium: | from 0.1 to 5.0 wt. %, |
| silicon: | from 2.0 to 8.0 wt. %, |
| manganese: | from 1.0 to 14.8 wt. %, |
| at least one element selected from the group consisting of: | |
| nickel: | from 0.1 to 20.0 wt. %, |
| cobalt: | from 0.1 to 30.0 wt. %, |
| copper: | from 0.1 to 3.0 wt. %, |
| and | |
| nitrogen: | from 0.001 to 0.400 wt. %, |
| where, $Ni + 0.5\ Mn + 0.4\ Co + 0.06\ Cu + 0.002\ N \geqq 0.67\ (Cr + 1.2\ Si)$, | |
| and | |
| the balance being iron and incidental impurities. | |

DETAILED DESCRIPTION OF PREFERRED EMBODIMENTS

Figure 1:
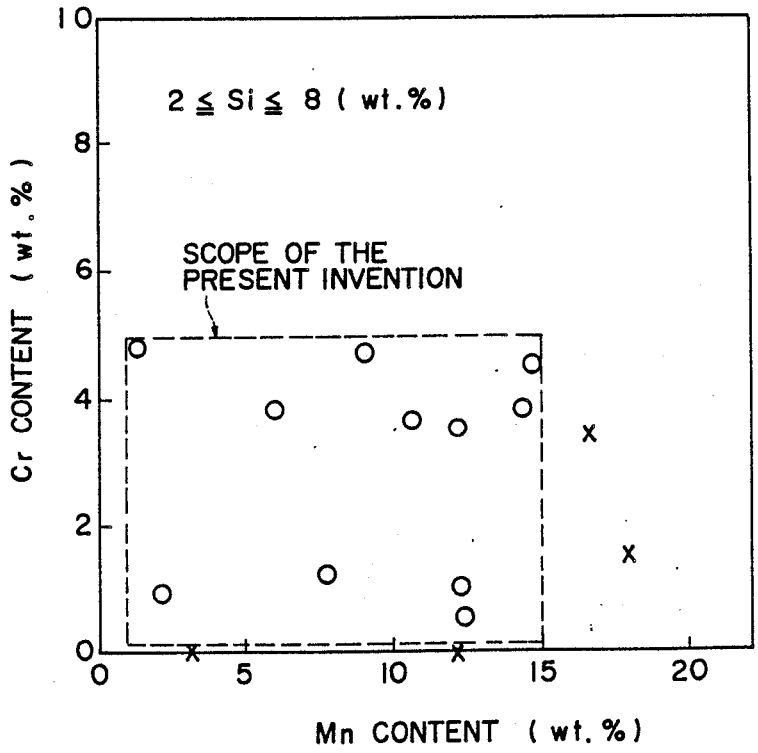
FIG. 1 is a graph illustrating the effect of contents of chromium, silicon and manganese on a corrosion resistance in an iron-based shape-memory alloy.

As described above, while the fct-type iron-based shape-memory alloy shows a saticfactory shape-memory property, the manufacturing cost thereof is high since it contains expensive metals such as platinum and palladium. In the bct-type iron-based shape-memory alloy, it is necessary to make the mother phase thereof have the invar effect so as to inhibit a slip deformation in the α'-martensite. The hcp-type iron-based shape-memory alloy has no such problems and can be manufactured at a relatively low cost.

When a plastic deformation is applied to a hcp-type iron-based shape-memory alloy at a prescribed temperature, the phase of the alloy transforms from the mother phase thereof, i.e., from austenite into a ε-martensite. When the alloy of which the mother phase has thus transformed into the ε-martensite is heated thereafter to a temperature above the austenitic transformation point (hereinafter referred to as the "Af point") and near the Af point, the ε-martensite reversely transforms into the mother phase thereof, i.e., into austenite, and as a result, the alloy applied with the plastic deformation recovers its original shape that the alloy has had before application of the plastic deformation.

In order to have the above-mentioned hcp-type iron-based shape-memory alloy display an excellent shape-memory property, the following conditions should be satisfied:

(1) The mother phase of the alloy, before application of the plastic deformation to the alloy at a prescribed temperature, must exclusively comprise austenite or mainly comprise austenite and contain a small quantity of the ε-martensite. The above-mentioned prescribed temperature means a temperature at which application of the plastic deformation to the alloy permits transformation from the mother phase into the ε-martensite.

(2) A stacking fault energy of austenite must be low. In addition, application of the plastic deformation to the alloy must cause transformation from the mother phase thereof exclusively into the ε-martensite, i.e., must not cause transformation inot the ε'-martensite.

(3) A yield strength of austenite must be high. Furthermore, application of the plastic deformation to the alloy must not cause a slip deformation in the crystal structure of the alloy.

From the above-mentioned point of view, extensive studies were carried out in order to develop a hcp-type iron-based shape-memory alloy satisfying the above-mentioned three conditions for the alloy to show a satifactory shape-memory property and be excellent in a corrosion resistance. As a result, the following findings were obtained;

(1) By adding chromium in a prescribed quantity to the alloy, it is possible to reduce a stacking fault energy of austenite, increase a yield strength of austenite, and improve a corrosion resistance of the alloy.

(2) By adding silicon in a prescribed quantity to the alloy, it is possible to reduce a stacking fault energy of austenite, and increase a yield strength of austenite.

(3) By adding manganese in a prescribed quantity to the alloy, it is possible to make the mother phase of the alloy, before application of the plastic deformation to the alloy, exclusively comprise austenite or mainly comprise austenite and contain a small quantity of the ε-martensite, and it is also possible to reduce a stacking fault energy of austenite.

(4) By adding to the alloy at least one element of nickel, cobalt, copper and nitrogen in a prescribed quantity, respectively, it is possible to make the mother phase of the alloy, before application of the plastic deformation to the alloy, exclusively comprise austenite or mainly comprise austenite and contain a small quantity of the ε-martensite.

(5) By limiting the ratio of the total content of Manganese, nickel, cobalt, copper and/or nitrogen, which are the austenite forming elements as described later, to the total content of chromium and/or silicon, which are the ferrite forming elements as described later, to a prescribed range, it is possible to make the mother phase of the alloy, before application of the plastic deformation to the alloy, exclusively comprise austenite or mainly comprise austenite and contain a small quantity of the ε-martensite.

The present invention was made on the basis of the above-mentioned findings, and the iron-based shape-memory alloy of the present invention excellent in a shape-memory property and a corrosion resistance consists essentially of:

| | |
|---|---|
| chromium: | from 0.1 to 5.0 wt. %, |
| silicon: | from 2.0 to 8.0 wt. %, |
| manganese: | from 1.0 to 14.8 wt. %, |
| at least one element selected from the group consisting of: | |
| nickel: | from 0.1 to 20.0 wt. %, |
| cobalt: | from 0.1 to 30.0 wt. %, |
| copper: | from 0.1 to 3.0 wt. %, |
| and | |
| nitrogen: | from 0.001 to 0.400 wt. %, |
| where, $Ni + 0.5\ Mn + 0.4\ Co + 0.06\ Cu + 0.002\ N \geqq 0.67\ (Cr + 1.2\ Si)$, | |
| and | |
| the balance being iron and incidental impurities. | |

Now, the reasons why the chemical composition of the iron-based shape-memory alloy of the present invention is limited as described above, and given below.

(1) Chromium

Chromium has a function of reducing a stacking fault energy of austenite and improving a corrosion resistance of the alloy. In addition, chromium has another function of increasing a yield strength of austenite. However, with a chromium content of under 0.1 wt. %, a desired effect as mentioned above cannot be obtained. A chromium content of over 5.0 wt. % is not allowed on the other hand for the following reasons: Because chromium is a ferrite forming element, an increased chromium content prevents austenite from being formed. For causing formation of austenite, therefore, manganese, which is an austenite forming element as described later, and at least one element of nickel, cobalt, copper and nitrogen, which are also austenite forming elements as described later, is added to the alloy in the present invention. For an increased chromium content, the above-mentioned austenite forming elements should also be added in a larger quantity. However, addition of the austenite forming elements in a large quantity is economically unfavorable. For these reasons, with a chromium content of over 5.0 wt. %, the necessity of a higher content of the austenite forming elements leads to economic disadvantages. The chromium content should therefore be limited within the range of from 0.1 to 5.0 wt. %.

(2) Silicon

Silicon has a function of reducing a stacking fault energy of austenite. In addition, silicon has another function of increasing a yield strength of austenite. However, with a silicon content of under 2.0 wt. %, a desired effect as mentioned above cannot be obtained. With a silicon content of over 8.0 wt. %, on the other hand, ductibility of the alloy seriously decrease, and hot workability and cold workability of the alloy largely deteriorate. The silicon content should therefore be limited within the range of from 2.0 to 8.0 wt. %.

(3) Manganese

Manganese is a strong element which forms austenite and has a function of making the mother phase of the alloy, before application of the plastic deformation to the alloy, exclusively comprise austenite or mainly comprise austenite and contain a small quantity of the ϵ-martensite. However, with a manganese content of under 1.0 wt. %, a desired effect as mentioned above cannot be obtained. With a manganese content of over 14.8 wt. %, on the other hand, a corrosion resistance deteriorates, and the δ-phase is easily formed. The manganese content should therefore be limited within the range of from 1.0 to 14.8 wt. %.

The effect of contents of manganese, chromium, and silicon on a corrosion resistance in an iron-based shape-memory alloy was investigated by means of the following test: Various samples were prepared in accordance with a method as presented later under the heading of "EXAMPLE" while changing the contents of chromium and manganese in an alloy steel containing from 2.0 to 8.0 wt. % silicon. Then, each of the thus prepared samples were subjected to an open air exposure for three months to evaluate the state of rust occurrence through visual inspection for each sample. The result of this test is shown in FIG. 1.

In FIG. 1, the abscissa represents a manganese content (wt. %) and the ordinate represents a chromium content (wt. %). The region enclosed by dotted lines in FIG. 1 indicates that the manganese content and the chromium content are within the scope of the present invention. Also in FIG. 1, the mark "  " indicates that no rust occurrence was observed, the mark "  " indicates that rust occurrence was observed to some extent; and the mark "x" indicates that rust occurrence was observed seriously. As is clear from FIG. 1, the samples having a manganese content within the range of from 1.0 to 14.8 wt. %, a chromium content within the range of from 0.1 to 5.0 wt. % and a silicon content within the range of from 2.0 to 8.0 wt. % show an excellent corrosion existance.

In the present invention, chromium and silicon, which are ferrite forming elements, and manganese, which is an austenite forming element, are added to the alloy, and furthermore, at least one element of nickle, cobalt, copper and nitrogen, which are austenite forming elements, is added to the alloy, so as to make the mother phase of the alloy, before application of the plastic deformation to the alloy, exclusively comprise austenite or mainly comprise austenite and contain a small quantity of the ϵ-martensite.

(4) Nickel

Nickel is a strong element which forms austenite and has a function of making the mother phase of the alloy, before application of the plastic deformation to the alloy, exclusively comprise austenite or mainly comprise austenite and contain a small quantity of the ϵ-martensite. However, with a nickel content of under 0.1 wt. %, a desired effect as mentioned above cannot be obtained. With a nickel content of over 20.0 wt. %, on the other hand, the ϵ-martensite transformation point (hereinafter referred to as the "Ms point") largely shifts toward the lower temperature region, and the temperature at which the plastic deformation is applied to the alloy becomes extremely low. The nickel content should therefore be limited within the range of from 0.1 to 20.0 wt. %.

(5) Cobalt

Cobalt is an austenite forming element and has a function of making the mother phase of the alloy, before application of the plastic deformation to the alloy, exclusively comprise austenite or mainly comprise austenite and contain a small quantity of the ϵ-martensite. Furthermore, cobalt has a function of hardly lowering the Ms point, whereas manganese, nickel, copper and nitrogen have a function of lowering the Ms point. Cobalt is therefore a very effective element for adjusting the Ms point within a desired temperature range. However, with a cobalt content of under 0.1 wt. %, a desired effect as mentioned above cannot be obtained. With a cobalt content of over 30.0 wt. %, on the other hand, no particular improvement is available in the above-mentioned effect. The cobalt content should therefore be limited within the range of from 0.1 to 30.0 wt. %.

(6) Copper

Copper is an austenite forming element and has a function of making the mother phase of the alloy, before application of the plastic deformation to the alloy, exclusively comprise austenite or mainly comprise austenite and contain a small quantity of the ϵ-martensite. Furthermore, copper has a function of improving corrosion resistance of the alloy. However, with a copper content of under 0.1 wt. %, a desired effect as mentioned above cannot be obtained. With a copper content of over 3.0 wt. %, on the other hand, formation of the ϵ-martensite is prevented. The reason is that copper has a function of increasing a stacking fault energy of austenite. The copper cotent should therefore be limited within the range of from 0.1 to 3.0 wt. %.

(7) Nitrogen

Nitrogen is an austenite forming element and has a function of making the mother phase of the alloy, before application of the plastic deformation to the alloy, exclusively comprise austenite or mainly comprise austenite and contain a small quantity of the ϵ-martensite. Furthermore, nitrogen has a function of improving a corrosion resistance of the alloy and increasing a yield strength of austenite. However, with a nitrogen content of under 0.001 wt. %, a desired effect as mentioned above cannot be obtained. With a nitrogen content of over 0.400 wt. %, on the other hand, formation of nitrides of chromium and silicon is facilitated, and a shape-memory property of the alloy deteriorates. The nitrogen content should therefore be limited within the range of from 0.001 to 0.400 wt. %.

(8) Ratio of the total content of the austenite forming elements to the total content of the ferrite forming elements:

In the present invention, as described above, it is indispensable that the mother phase of the alloy, before application of the plastic deformation to the alloy at a prescribed temperature, exclusively comprises austenite or mainly comprises austenite and contains a small quantity of the ϵ-martensite. In the present invention, therefore, the following formula should be satisfied in addition to the above-mentioned limitations to the chemical composition of the alloy of the present invention:

$$Ni+0.5Mn+0.4Co+0.06Cu+0.002N \geqq 0.67(Cr+1.2Si),$$

An austenite forming ability of the austenite forming elements contained in the alloy of the present invention is expressed as follows in terms of a nickel equivalent:

$$\text{Nickel equivalent} = Ni+0.5Mn+0.4Co+0.06Cu+0.002N$$

The nickel equivalent is an indicator of the austenite forming ability.

A ferrite forming ability of the ferrite forming elements contained in the alloy of the present invention is expressed as follows in terms of a chromium equivalent:

$$\text{Chromium equivalent} = Cr+1.2Si$$

The chromium equivalent is an indicator of the ferrite forming ability.

By satisfying the above-mentioned formula, it is possible to make the mother phase of the alloy, before application of the plastic deformation to the alloy at a prescribed temperature, exclusively comprise austenite or mainly comprise austenite and contain a small quantity of the ϵ-martensite.

(9) Impurities

The contents of carbon, phosphorus and sulfur, which are impurities, should preferably be up to 1 wt. % for carbon, up to 0.1 wt. % for phosphorus and up to 0.1 wt. % for sulfur.

Now, the iron-base shape-memory alloy of the present invention is described further in detail by means of examples while comparing with alloy steels for comparison outside the scope of the present invention.

EXAMPLE

Alloy steels of the present invention having chemical compositions within the scope of the present invention as shown in Table 1, and alloy steels for comparison having chemical compositions outside the scope of the present invention as shown also in Table 1, were melted in a melting furnace under atmospheric pressure or under vacuum, then cast into ingots. Subsequently, the resultant ingots were heated to a temperature within the range of from 1,000° to 1,250° C., and then hot-rolled to a thickness of 12 mm, to prepare samples of the alloy steels in the present invention (hereinafter referred to as the "samples of the invention") Nos. 1 to 11, and samples of the alloy steels for comparison outside the scope of the present invention (hereinafter referred to as the "samples for comparison") Nos. 1 to 9.

Then, a shape-memory property, and a corrosion resistance were investigated for each of the samples of the invention Nos. 1 to 11 and the samples for comparison Nos. 1 to 9 by means of the tests as described below. The results of these tests are shown in Table 2.

TABLE 1

| | | Chemical composition (wt. %) | | | | | | |
|---|---|---|---|---|---|---|---|---|
| | No. | Cr | Si | Mn | Ni | Co | Cu | N |
| Sample of the invention | 1 | 3.8 | 2.5 | 14.3 | 6.0 | — | — | 0.003 |
| | 2 | 3.5 | 5.8 | 12.1 | 7.5 | — | — | 0.003 |
| | 3 | 3.6 | 7.6 | 10.5 | 10.3 | — | — | 0.004 |
| | 4 | 4.8 | 5.9 | 1.4 | 7.5 | 14.3 | — | — |
| | 5 | 0.5 | 6.2 | 12.4 | 8.1 | 6.7 | — | 0.003 |
| | 6 | 4.5 | 5.9 | 14.6 | 1.9 | 1.3 | 1.8 | 0.013 |
| | 7 | 3.8 | 5.8 | 5.8 | 18.2 | — | — | — |
| | 8 | 4.7 | 6.3 | 8.8 | — | 27.9 | — | 0.003 |
| | 9 | 1.0 | 5.9 | 12.3 | 7.0 | — | 0.5 | 0.002 |
| | 10 | 1.2 | 6.1 | 7.8 | 6.5 | 6.8 | 2.7 | 0.004 |
| | 11 | 3.1 | 6.3 | 10.7 | 7.5 | — | — | 0.381 |
| Sample for comparison | 1 | 3.5 | 1.6 | 14.6 | 6.3 | — | — | 0.002 |
| | 2 | 3.1 | 8.4 | 10.5 | 10.3 | — | — | 0.004 |
| | 3 | 4.5 | 5.7 | 0.6 | 7.8 | 14.7 | — | 0.003 |
| | 4 | 3.4 | 5.9 | 16.6 | 5.8 | — | — | 0.004 |
| | 5 | 0.05 | 6.1 | 12.2 | 7.8 | 6.3 | — | 0.002 |
| | 6 | 3.7 | 5.9 | 12.3 | 21.3 | — | — | 0.004 |
| | 7 | 3.6 | 6.1 | 12.4 | 6.2 | — | 3.4 | 0.002 |

TABLE 1-continued

| | Chemical composition (wt. %) | | | | | | |
|---|---|---|---|---|---|---|---|
| No. | Cr | Si | Mn | Ni | Co | Cu | N |
| 8 | 3.3 | 6.0 | 10.2 | 7.1 | — | — | 0.419 |
| 9 | 4.3 | 7.0 | 6.8 | 2.3 | — | — | 0.002 |

TABLE 2

| | No | Deformation temperature | Shape-memory property | Corrosion resistance |
|---|---|---|---|---|
| Sample of the invention | 1 | Room temp. | | |
| | 2 | Room temp. | | |
| | 3 | −80° C. | | |
| | 4 | Room temp. | | |
| | 5 | Room temp. | | |
| | 6 | Room temp. | | |
| | 7 | −196° C. | | |
| | 8 | Room temp. | | |
| | 9 | Room temp. | | |
| | 10 | −80° C. | | |
| | 11 | −80° C. | | |
| Sample for comparison | 1 | Room temp. | x | |
| | 2 | −80° C. | x Cracks produced | |
| | 3 | Room temp. | x | |
| | 4 | Room temp. | | x |
| | 5 | Room temp. | | x |
| | 6 | −196° C. | x | |
| | 7 | −80° C. | x | |
| | 8 | −196° C. | x | |
| | 9 | Room temp. | x | |

(1) Shape-memory property

A shape-memory property was investigated through a tensile test which comprises: cutting a round-bar test piece having a diameter of 6 mm and a gauge length of 30 mm from each of the samples of the invention Nos. 1 to 11 and the samples for comparison Nos. 1 to 9 prepared as mentioned above; applying a tensile strain of 4% to each of the thus cut test pieces at a deformation temperature as shown in Table 2; then heating each test piece to a prescribed temperature above the Af point and near the Af point; then measuring a gauge length of each test piece after application of the tensile strain and heating; and calculating a shape recovery rate on the basis of the result of measurement of the gauge length to evaluate a shape-memory property of each sample. The result of the above-mentioned tensile test is also shown in Table 2 under the column "shape-memory property".

The evaluation criteria of the shape-memory property were as follows:

: The shape recovery rate is at least 70%,

: The shape recovery rate is from 30 to under 70%, and x: The shape recovery rate is under 30%.

The shape recovery rate was calculated in accordance with the following formula:

$$\text{Shape recovery rate (\%)} = \frac{L_1 - L_2}{L_1 - L_o} \times 100$$

where $L_o$: initial gauge length of the test piece, $L_1$: gauge length of the test piece after application of tensile strain, and $L_2$: gauge length of the test piece after heating.

Since the Ms point differs between the samples, an optimum temperature for application of the plastic deformation was set for each test piece. Such temperatures are shown in Table 2 under the column "Deformation temperature."

(2) Corrosion resistance

An air exposure test for a year was applied to each of the samples of the invention Nos. 1 to 11 and the samples for comparison Nos. 1 to 9 to investigate a corrosion resistance thereof. After the completion of the test, the state of rust occurrence was evaluated through visual inspection for each sample. The result of the test is also shown in Table 2 under the column "Corrosion resistance."

The evaluation criteria of the rust occurrence were as follows:

: No rust occurrence is observed; or rust occurrence is observed to some extent; and x: Rust occurrence is observed seriously.

As is clear from Tables 1 and 2, the sample for comparison No. 1 is poor in a shape-memory property because of the low silicon content outside the scope of the present invention.

The sample for comparison No. 2 is poor in a shape-memory property because of the high silicon content outside the scope of the present invention. In addition, occurrence of cracks is observed in the sample for comparison No. 2.

The sample fo comparison No. 3 is poor in a shape-memory property because of the low manganese content outside the scope of the present invention.

The sample for comparison No. 4 is poor in a corrosion resistance because of the high manganese content outside the scope of the present invention.

The sample for comparison No. 5 is poor in a corrosion resistance because of the low chromium content outside the scope of the present invention.

The sample of comparison No. 6 is poor in a shape-memory property because of the high nickel content outside the scope of the present invention.

The sample for comparison No. 7 is poor in a shape-memory property because of the high copper content outside the scope of the present invention.

The sample for comparison No. 8 is poor in a shape-memory property because of the high nitrogen content outside the scope of the present invention.

The smaple for comparison No. 9 is poor in a shape-memory property because the formula of "$Ni+0.5Mn+0.4Co+0.06Cu+0.002N \geqq 0.67(Cr+1.2Si)$" is not satisfied.

In contrast, all the samples of the invention Nos. 1 to 11 are excellent in a shape-memory property and a corrosion resistance.

As described above in detail, the iron-based shape-memory alloy of the present invention is excellent in a shape-memory property and a corrosion resistance, and is adapted to be used as a material for a pipe joint, various tightening devices and the like and as a biomaterial, and permits reduction of the manufacturing cost thereof, thus providing industrially useful effects.

What is claimed is:

1. An iron-based shape-memory alloy excellent in a shape-memory property and a corrosion resistance, consisting essentially of:

chromium: from 0.1 to 5.0 wt. %,
silicon: from 2.0 to 8.0 wt. %,
manganese: from 1.0 to 14.8 wt. %,
at least one element selected from the group consisting of:

-continued

| | |
|---|---|
| nickel: | from 0.1 to 20.0 wt. %, |
| cobalt: | from 0.1 to 30.0 wt. %, |
| copper: | from 0.1 to 3.0 wt. %, |
| and | |
| nitrogen: | from 0.001 to 0.400 wt. %, |
| where, Ni + 0.5 Mn + 0.4 Co + 0.06 Cu + 0.002 N ≧ 0.67 (Cr + 1.2 Si), | |
| and | |
| the balance being iron and incidental impurities. | |

2. The iron-based shape-memory alloy of claim 1 consisting essentially of 3.8% chromium, 2.5% silicon, 14.3% manganese, 6.0% nickel and 0.003% nitrogen and the balance iron.

3. The iron-based shape-memory alloy of claim 1 consisting essentially of 3.5% chromium, 5.8% silicon, 12.1% manganese, 7.5% nickel, and 0.003% nitrogen and the balance iron.

4. The iron-based shape-memory alloy of claim 1 consisting essentially of 3.6% chromium, 7.6% silicon, 10.5% manganese, 10.3% nickel and 0.004% nitrogen and the balance iron.

5. The iron-based shape-memory alloy of claim 1 consisting essentially of 4.8% chromium, 5.9% silicon, 1.4% manganese, 7.5% nickel, 14.3% cobalt and the balance iron.

6. The iron-bases shaped-memory alloy of claim 1 consisting essentially of 0.5% chromium, 6.2% silicon, 12.4% manganese, 8.1% nickel, 6.7% cobalt and 0.003 nitrogen the balance iron.

7. The iron-based shaped-memory alloy of claim 1 consisting essentially of 4.5% chromium, 5.9% silicon, 14.6% manganese, 1.9% nickel, 1.3% cobalt, 1.8 copper and 0.013% nitrogen and the balance iron.

8. The iron-based shape-memory alloy of claim 1 consisting essentially of 3.8% chromium, 5.8% silicon, 5.8 manganese, 18.2% nickel and the balance iron.

9. The iron-based shape-memory alloy of claim 1 consisting essentially of 4.7% chromium, 6.3% silicon, 8.8% manganese, 27.9% cobalt and 0.003% nitrogen and the balance iron.

10. The iron-based shape-memory alloy of claim 1 consisting essentially of 1.0% chromium, 5.9% silicon, 12.3% manganese, 7.0% nickel, 0.5% copper 0.002% nitrogen and the balance iron.

11. The iron-based shape-memory alloy of claim 1 consisting essentially of 1.2% chromium, 6.1% silicon, 7.8% manganese, 6.5% nickel, 6.8% cobalt, 2.7% copper and 0.004% nitrogen and the balance iron.

12. The iron-based shape-memory alloy of claim 1 consisting essentially of 3.1% chromium, 6.3% silicon, 10.7% manganese, 7.5% nickel, and 0.381% nitrogen and the balance iron.

* * * * *

UNITED STATES PATENT AND TRADEMARK OFFICE

CERTIFICATE OF CORRECTION

PATENT NO. : 4,929,289

DATED : May 29, 1990

INVENTOR(S) : MORIYA et al

It is certified that error appears in the above-identified patent and that said Letters Patent is hereby corrected as shown below:

Title page:

Under "FOREIGN PATENT DOCUMENTS", insert

--201761 9/1986 Japan--

Under "OTHER DOCUMENTS", insert

--PATENT ABSTRACTS OF JAPAN, vol. 8, No.187 (C-240) [1624], 28th August 1984, JP 59-83744, SHAPE MEMORY ALLOY--.

Column 12, line 1 (Claim 6):

Change "iron-bases shaped-memory" to --iron-based shape-memory--.

Column 12, line 3 (Claim 6):

After "0.003" insert -- % --.

Column 12, line 4 (Claim 6):

After "nitrogen", insert -- and --.

Column 12, line 5 (Claim 7):

Change "shaped-memory" to -- shape-memory --.

UNITED STATES PATENT AND TRADEMARK OFFICE

CERTIFICATE OF CORRECTION

PATENT NO. : 4,929,289

DATED : May 29, 1990

INVENTOR(S) : MORIYA et al

It is certified that error appears in the above-identified patent and that said Letters Patent is hereby corrected as shown below:

Column 12, line 7 (Claim 7):

After "1.8", insert -- % --.

Column 12,line 11 (Claim 8):

After "5.8", insert -- % --.

Column 12, line 18 (Claim 10):

After "copper", insert -- , --.

Signed and Sealed this

Thirteenth Day of July, 1993

*Attest:*

Michael K. Kirk

MICHAEL K. KIRK

*Attesting Officer*

*Acting Commissioner of Patents and Trademarks*